US008858191B2

(12) United States Patent
Onda

(10) Patent No.: US 8,858,191 B2
(45) Date of Patent: Oct. 14, 2014

(54) SWASH PLATE TYPE COMPRESSOR

(75) Inventor: Takamasa Onda, Tatebayashi (JP)

(73) Assignee: Calsonic Kansei Corporation, Saitama-shi (JP)

( * ) Notice: Subject to any disclaimer, the term of this patent is extended or adjusted under 35 U.S.C. 154(b) by 802 days.

(21) Appl. No.: 12/936,082

(22) PCT Filed: Apr. 6, 2009

(86) PCT No.: PCT/JP2009/057070

§ 371 (c)(1),
(2), (4) Date: Oct. 1, 2010

(87) PCT Pub. No.: WO2009/125749

PCT Pub. Date: Oct. 15, 2009

(65) Prior Publication Data

US 2011/0020147 A1 Jan. 27, 2011

(30) Foreign Application Priority Data

Apr. 7, 2008 (JP) ..... 2008-099147

(51) Int. Cl.
*F04B 27/14* (2006.01)
*F04B 49/24* (2006.01)

(52) U.S. Cl.
USPC ..... 417/222.2; 417/272; 62/228.3

(58) Field of Classification Search
USPC ..... 417/222.2, 272; 62/228.3
See application file for complete search history.

(56) References Cited

U.S. PATENT DOCUMENTS 4,632,358 A * 12/1986 Orth et al. ..... 251/117
4,688,997 A * 8/1987 Suzuki et al. ..... 417/222.2
4,730,986 A * 3/1988 Kayukawa et al. ..... 417/222.2
4,928,723 A * 5/1990 Itahana et al. ..... 137/116.3
6,250,094 B1 * 6/2001 Ban et al. ..... 62/228.3
6,293,117 B1 * 9/2001 Ban et al. ..... 62/228.3
6,302,656 B1 * 10/2001 Hirota ..... 417/222.2
6,332,329 B1 * 12/2001 Takehana et al. ..... 62/227
6,481,977 B2 * 11/2002 Mameda et al. ..... 417/222.2
6,595,015 B2 * 7/2003 Fujii et al. ..... 62/228.3
7,364,408 B2 * 4/2008 Skinner et al. ..... 417/222.2
8,292,596 B2 * 10/2012 Ota et al. ..... 417/222.1
2001/0016168 A1 * 8/2001 Mameda et al. ..... 417/222.2
2003/0154731 A1 * 8/2003 Imai et al. ..... 62/228.3

FOREIGN PATENT DOCUMENTS

JP 2001-132631 A 5/2001
JP 2001132631 A * 5/2001 ..... F04B 27/14
JP 3780784 B2 3/2006
JP 2009-024693 A 2/2009
JP 2009024693 A * 2/2009

OTHER PUBLICATIONS

Japanese Office Action and English Translation, dated Jul. 25, 2012, 4 pages.

* cited by examiner

*Primary Examiner* — Nathan Zollinger
(74) *Attorney, Agent, or Firm* — Foley & Lardner LLP

(57) ABSTRACT

In a swash plate type compressor, provided is an introduction flow passage through which refrigerant is introduced from a suction chamber. Further, a differential pressure control valve is provided on the introduction flow passage. The differential pressure control valve acts due to a differential pressure (Pc−Ps) between a crank pressure Pc and a suction pressure Ps. An opening of the introduction flow passage is adjusted by the differential pressure control valve so as to prevent the crank pressure Pc from exceeding a predetermined value. According to the swash plate type compressor, an excessive elevation of the crank pressure Pc can be prevented without a usage of a check valve.

1 Claim, 4 Drawing Sheets

SWASH PLATE TYPE COMPRESSOR

TECHNICAL FIELD

The present invention relates to a swash plate type compressor.

BACKGROUND ART

In a Patent Document 1, "an air conditioner and a control valve of a variable capacity type compressor" are described. This variable capacity type compressor is a swash plate type compressor. A discharge amount of the swash plate type compressor is controlled by adjusting a swash angle of a swash plate. The swash angle of the swash plate is adjusted by feeding high-pressure refrigerant discharged into a discharge chamber back to a swash plate chamber (crank chamber) via a capacity control valve.

CITATION LIST

Patent Document(s)

Patent Document 1: Japanese Granted Patent No. 3780784

SUMMARY OF INVENTION

With the capacity control valve, when switching pistons into a destroke state (deactivating a compartment air conditioner), the capacity control valve is opened. If the capacity control valve is opened or repeatedly activated and deactivated, a rapid elevation of a crank pressure Pc (inner pressure in the crank chamber) may be caused by a supply of the high-pressure refrigerant to the crank chamber and then sealing agents and functional components may be damaged. As a result, reliability of the device may be diminished due to leaks of refrigerant gas and lubricating oil.

In addition, under a condition where the high-pressure refrigerant flows reversely from its refrigeration system, a further elevation of the crank pressure Pc may be caused by a supply of the very high-pressure refrigerant to the crank chamber. In a case where a check valve is disposed between the discharge chamber and the system to prevent the reverse flow, the check valve may become a flow resistance against a flow of the discharged refrigerant and cause pressure loss and efficiency reduction.

Therefore, an object of the present invention is to provide a swash plate type compressor that can prevent an excessive elevation of a crank pressure Pc without a usage of a check valve.

An aspect of the present invention provides a swash plate type compressor that includes: a swash plate provided swingably whose swash angle to a rotational central axis is adjustable; a compression mechanism that is composed of a piston and a cylinder, and driven due to a swing of the swash plate to compress gas suctioned from a suction chamber and to discharge to a discharge chamber; a crank chamber that applies a crank pressure Pc to the swash plate and a head of the piston; a capacity control valve that adjusts the swash angle of the swash plate by introducing the gas in the discharge chamber to the crank chamber through an introduction flow passage; and a differential pressure control valve that acts due to a differential pressure (Pc−Ps) between the crank pressure Pc of the crank chamber and a suction pressure Ps of the compression mechanism and adjusts an opening of the introduction flow passage to prevent the crank pressure Pc from exceeding a predeteiiuined value.

According to the aspect, an excessive elevation of the crank pressure Pc can be prevented by controlling the opening of the introduction flow passage by the differential pressure control valve so as to prevent the crank pressure Pc from exceeding the predetermined value, and thereby prevented can be damages of sealing agents and functional components, lubricating oil leakage, and reliability reduction.

In addition, in a case where the high-pressure refrigerant flows reversely from a side of its system, even if the reversely-flowing high-pressure refrigerant is supplied from the capacity control valve (the introduction flow passage) to the crank chamber, the differential pressure control valve acts along with the elevation of the crank pressure Pc and thereby a further elevation of the crank pressure Pc can be prevented.

In addition, since the differential pressure control valve is acted by use of the differential pressure (Pc−Ps) of the crank pressure Pc and the suction pressure Ps, no check valve is needed and thereby prevented can be pressure loss and efficiency reduction due to a usage of a check valve.

Here, it is preferable that the differential pressure control valve includes a valve body and an urging unit that urges the valve body in a direction for opening the introduction flow passage; and the valve body is provided movably between a close position and an open position of the introduction flow passage, receives a force for moving toward the close position by the crank pressure Pc, receives a force for moving toward the open position by the suction pressure Ps, and moves to the close position to close the introduction flow passage when the differential pressure (Pc−Ps) exceeds an urging force of the urging unit.

According to this, the valve body moves and closes the introduction flow passage to prevent the excessive elevation of the crank pressure Pc when the differential pressure (Pc−Ps) exceeds the urging force of the urging unit, and thereby the above-mentioned advantages can be achieved.

In addition, here, it is preferable that the differential pressure control valve closes the introduction flow passage when the differential pressure (Pc−Ps) exceeds a closing criterion value, and opens the introduction flow passage when the differential pressure (Pc−Ps) becomes equal-to or lower than an opening criterion value.

According to this, the differential pressure control valve closes the introduction flow passage when the differential pressure (Pc−Ps) exceeds the closing criterion value, and thereby the above-mentioned advantages can be achieved.

In addition, in a drive state where the differential pressure (Pc−Ps) fluctuates across a fixed criterion value, the differential pressure control valve is opened and closed repeatedly to send a given amount of gas to the crank chamber.

Generally, if gas is not sent to the crank chamber, the crank pressure Pc decreases and then the swash angle of the swash plate, i.e. a discharged gas amount increases. In this case, the discharged amount cannot be reduced to its minimum amount. However, according to this, such a trouble can be solved by sending the given amount of gas to the crank chamber.

Note that, at this time, a gas amount sent to the crank chamber is sufficiently small, and thereby the excessive elevation of the crank pressure Pc never occurs.

Further, it is preferable that a stopper that restrains the valve body in the close position, and a bypass passage (e.g. an appropriate gap) is provided between the valve body and the introduction flow passage, along which a given amount of gas flows through the bypass passage in a state where the valve body is restrained by the stopper.

According to this, since the given amount of gas (restricted flow amount of gas) is sent to the crank chamber through the bypass passage that is formed when the valve body is restrained by the stopper, prevented can be an elevation of the discharge amount due to reduction of the crank pressure Pc.

Note that, at this time, a gas amount sent to the crank chamber is sufficiently small, and thereby the excessive elevation of the crank pressure Pc never occurs.

Alternatively, it is preferable that a bypass passage is formed on the valve body, and a given amount of gas flows along the introduction flow passage through the bypass passage in a state where the valve body moves to the close position.

According to this, since the given amount of gas (restricted flow amount of gas) is sent to the crank chamber through the bypass passage formed on the valve body, prevented can be an elevation of the discharge amount due to reduction of the crank pressure Pc.

Note that, at this time, a gas amount sent to the crank chamber is sufficiently small, and thereby the excessive elevation of the crank pressure Pc never occurs.

BEST MODE FOR CARRYING OUT INVENTION

<First Embodiment>

A swash plate type compressor 1 in a first embodiment will be explained with reference to FIG. 1 to FIG. 3.

Figure 1:
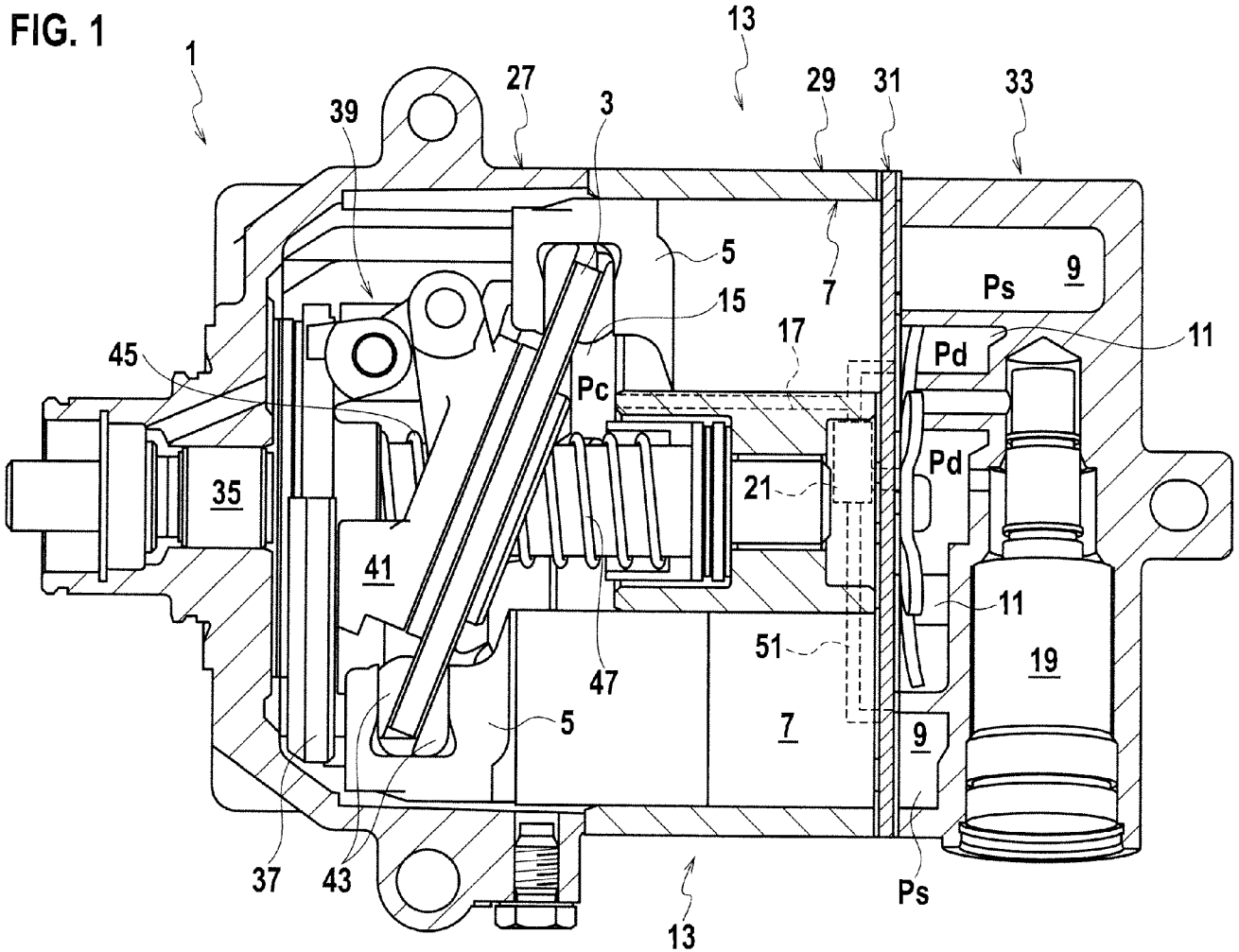
[FIG. 1] is a vertical cross-sectional view of a swash plate type compressor in a first embodiment according to the present invention.

As shown in FIG. 1, the swash plate type compressor 1 includes a swash plate 3, compression mechanisms 13, a crank chamber 15 and a capacity control valve 19. The swash plate 3 has pistons 5 and cylinders 7. The compression mechanisms 13 are driven by an inclined rotation of the swash plate 3 to compress refrigerant (gas) suctioned from a suction chamber 9 and then discharge it to a discharge chamber 11. By the crank chamber 15, a crank pressure Pc is applied to the swash plate 3 and the heads of the pistons 5. By the capacity control valve 19, the refrigerant in the discharge chamber 11 is introduced into the crank chamber 15 through an introduction flow passage 17 and a swash angle of the swash plate 3 is adjusted. Further, a differential pressure control valve 21 is provided. The differential pressure control valve 21 acts due to a differential pressure (Pc - Ps) between a crank pressure Pc of the crank chamber 15 and a suction pressure Ps of the compression mechanisms 13. By the differential pressure control valve 21, an opening of the introduction flow passage 17 is adjusted so as to prevent the crank pressure Pc from exceeding a predetermined value.

Figure 2:
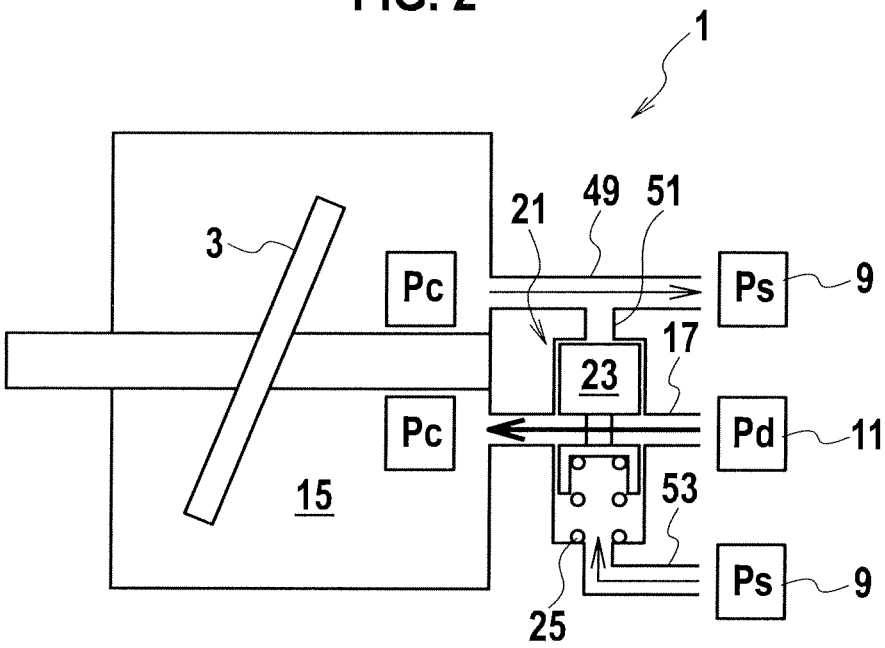
[FIG. 2] is a schematic view of the swash plate type compressor.
Figure 3:
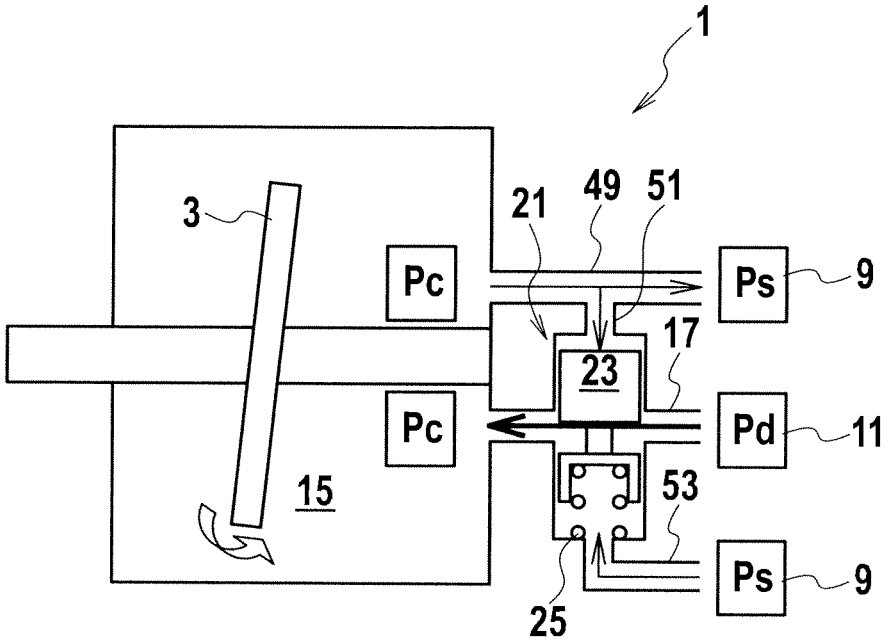
[FIG. 3] is a schematic view of the swash plate type compressor.

In addition, the differential pressure control valve 21 includes a slide valve 23 (valve body) and a coil spring 25 (urging unit) as shown in FIG. 2 and FIG. 3. The slide valve 23 is provided movably between a close position and an open position (see FIG. 2) of the introduction flow passage 17. The coil spring 25 urges the slide valve 23 in a direction for opening the introduction flow passage 17. When the differential pressure (Pc−Ps) exceeds an urging force of the coil spring 25, the slide valve 23 is moved toward the close position to close the introduction flow passage 17.

Next, configuration of the swash plate type compressor 1 will be explained.

The swash plate type compressor 1 is used in a refrigeration system of an air conditioner for a vehicle, and compresses refrigerant suctioned from an evaporator to supply a condenser.

As shown in FIG. 1, the swash plate type compressor 1 includes a front housing 27, a cylinder block 29, a valve plate 31 and a rear housing 33, and these are integrally fixed each other by through bolts. The crank chamber 15 is formed between the front housing 27 and the cylinder block 29. A lug plate 37 is fixed on a drive shaft 35. The lug plate 37 is swingably coupled with a journal 41 via a link mechanism 39. The journal 41 can be slide on the drive shaft 35 along its axial direction. The swash plate 3 is fixed on the journal 41, and the swash plate 3 and the pistons 5 are swingably coupled with each other via piston shoes 43, 43. Six of the cylinders 7 are equiangularly formed in the cylinder block 29 at regular intervals. The pistons 5 can be reciprocated in the pistons 7, respectively, and six sets of the compression mechanisms 13 are configured.

The swash plate 3 and the journal 41 are supported along the axial direction by springs 45, 47, the above-described differential pressure (Pc−Ps) and so on. When the journal 41 moves toward the cylinder block 29, the swash angle of the swash plate 3, i.e. each stroke of the pistons 5 reduces. On the contrary, when the journal 41 moves toward the lug plate 37, the swash angle of the swash plate 3, i.e. each stroke of the pistons 5 increases.

The suction chamber 9 and the discharge chamber 11 are provided in the rear housing 33. The suction chamber 9 is connected with a side of the evaporator, and the discharge chamber 11 is connected with a side of the condenser. The swash angle of the swash plate 3 is adjusted through the differential pressure (Pc−Ps) controlled through an adjustment of an opening of a built-in valve of the capacity control valve 19, under control by a controller, to supply the refrigerant from the discharge chamber 11 to the crank chamber 15 via the introduction flow passage 17. When the capacity control valve 19 is made deactivated, the built-in valve is made full-opened.

A drive power form an engine that is input to the drive shaft 35 via an input pulley rotates the journal 41 and the swash plate 3 by way of the lug plate 37 and the link mechanism 39. The swash plate 3, while rotating, reciprocates the pistons 5 with a stroke according to its swash angle to drive the compression mechanisms 13. Each of the compression mechanisms 13 suctions the refrigerant from the suction chamber 9 by an amount according to the stroke and compresses it to discharge it to the discharge chamber 11.

As shown in FIG. 2 and FIG. 3, a gas-extraction flow passage 49 and its branched flow passage 51 are provided between the suction chamber 9 and the crank chamber 15. The gas-extraction flow passage 49 and the branched flow passage 51 apply the crank pressure Pc to the slide valve 23. A control flow passage 53 is provided between the suction chamber 9 and the introduction flow passage 17. The control flow passage 53 applies the suction pressure Ps to the slide valve 23. Due to the crank pressure Pc through the gas-extraction flow passage 49 and the branched flow passage 51, the slide valve 23 is pressed toward the close position of the introduction flow passage 17. Due to the urging force of the coil spring 25 and the suction pressure Ps through the control flow passage 53, the slide valve 23 is urged toward the open position of the introduction flow passage 17.

In a case of car-parking or stop-driving, or a case in which a discharged amount is decreased even during a normal operation, the capacity control valve 19 is deactivated to fully open its built-in valve. Therefore, while the crank pressure Pc doesn't excessively rise, the slide valve 23 is held, as shown in FIG. 2, in the open position of the introduction flow passage 17 due to the urging force of the coil spring 25 and the suction pressure Ps through the control flow passage 53. The high-pressure refrigerant in the discharge chamber 11 moves to the crank chamber 15 through the capacity control valve 19 (fully-opened built-in valve) and the differential pressure control valve 21 (fully-opened slide valve 23). As a result, the crank pressure Pc increases and thereby the swash angle of the swash plate 3, i.e., each discharge amount of the compression mechanisms 13, decreases.

At this time, if the crank pressure Pc continues to increase, the crank pressure Pc moves, as shown in FIG. 2, the slid valve 23 against the urging forge of the coil spring 25 and the suction pressure Ps. As a result, (the opening of) the introduction flow passage 17 is narrowed down to limit the refrigerant flow amount and the excessive elevation of the crank pressure Pc is prevented. In addition, when the crank pressure Pc further continues to increase and exceeds a sum of the urging forge of the coil spring 25 and the suction pressure Ps, the slide valve 23 moves to the close position of the introduction flow passage 17 and the elevation of the crank pressure Pc is stopped.

In addition, even under a condition where the crank pressure Pc continues to rise due to a reverse flow of the high-pressure refrigerant from its refrigeration system, the introduction flow passage 17 is narrowed down or hull closed due to the movement of the slide valve 23 along with the elevation of the crank pressure Pc as described above. Therefore, flowing of the refrigerant into the crank chamber 15 is restricted or stopped and thereby the excessive elevation of the crank pressure Pc is prevented.

Next, advantages by the swash plate type compressor 1 will be explained.

Since the excessive elevation of the crank pressure Pc is prevented by the differential pressure control valve 21, it can be prevented that sealing agents and functional components are damaged and reliability is reduced.

In addition, even in a case where the high-pressure refrigerant flows reversely from its refrigeration system, since the excessive elevation of the crank pressure Pc is prevented by the differential pressure control valve 21, no check valve is needed and thereby pressure loss and efficiency reduction due to a usage of a check valve can be prevented.

<Second Embodiment>

Figure 4:
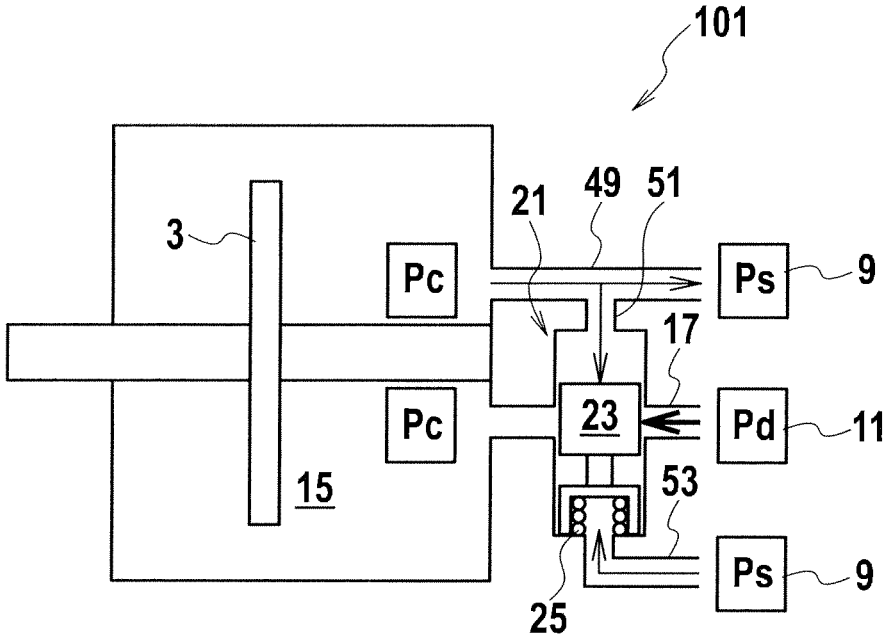
[FIG. 4] is a schematic view of a swash plate type compressor in a second embodiment according to the present invention.

A swash plate type compressor 101 in a second embodiment will be explained with reference to FIG. 4. Hereinafter, different points from the swash plate type compressor 1 in the first embodiment will be explained.

In the swash plate type compressor 101, the introduction flow passage 17 is closed by the differential pressure control valve 21 and an open criterion value of the differential pressure control valve 21 is set to 0.7 MPa. When the differential pressure (Pc−Ps) between the crank pressure Pc and the suction pressure Ps exceeds 0.7 MPa, the slide valve 23 moves to the close position of the introduction flow passage 17 against the urging force of the coil spring 25. When the differential pressure (Pc−Ps) becomes equal-to or less-than 0.7 MPa, the slide valve 23 is moved back to the open position of the introduction flow passage 17 by the urging force of the coil spring 25.

Generally, if the refrigerant is not sent to the crank chamber 15 due to the full-close of the introduction flow passage 17, the crank pressure Pc may decrease and then the swash angle of the swash plate 3, i.e. each discharge amount of each of the compression mechanisms 13 may increase. In this case, the discharge amount cannot be reduced to its minimum amount. However, in the swash plate type compressor 101 in the present embodiment, since the open criterion value of the differential pressure control valve 21 is set to a fixed value (0.7 MPa) as described above, a given amount of the refrigerant is sent to the crank chamber 15 due to repeated opens and closes of the differential pressure control valve 21 in a drive state where the differential pressure (Pc−Ps) fluctuates across the 0.7 Mpa. Therefore, the above-mentioned trouble is solved and a function to reduce the discharge amount to its minimum value is ensured.

In addition, with respect to the differential pressure control valve 21 (the slide valve 23), a specific difference may be set between the differential pressure (Pc−Ps) for closing the introduction flow passage 17 (closing criterion value) and the differential pressure (Pc−Ps) for opening the introduction flow passage 17 (opening criterion value). For example, the introduction flow passage 17 may be closed when the differential pressure (Pc−Ps) exceeds 0.8 MPa (closing criterion value), and the introduction flow passage 17 may be opened when the differential pressure (Pc−Ps) becomes equal-to or lower-than 0.6 MPa (opening criterion value).

In this case, the introduction flow passage 17 is made half-opened in a range 0.8 to 0.6 MPa of the differential pressure (Pc−Ps) and a given amount of the refrigerant is sent to the crank chamber 15. Therefore, the above-mentioned trouble is solved and a function to reduce the discharge amount to its minimum value is ensured, similarly to the above case.

<Third Embodiment>

Figure 5:
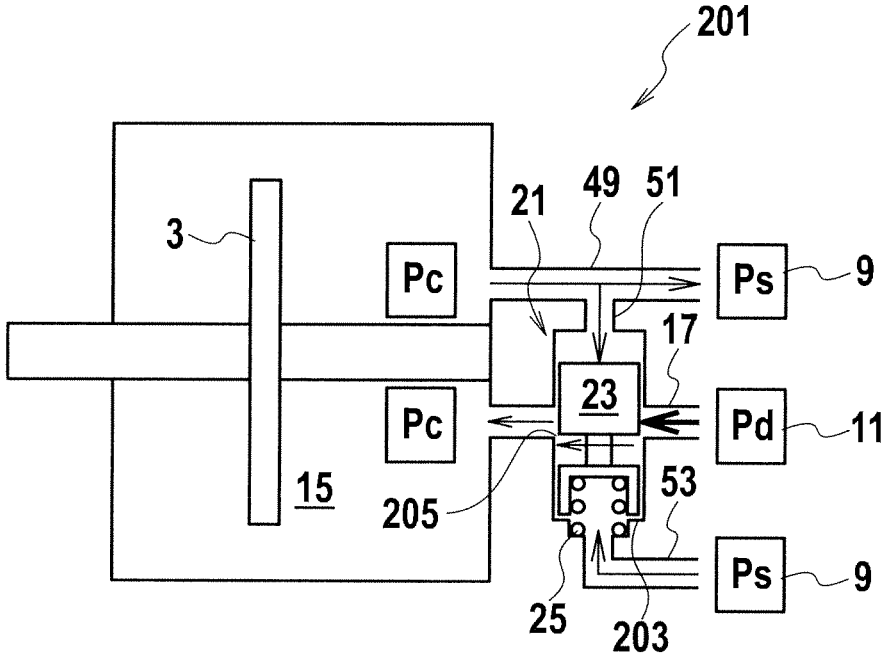
[FIG. 5] is a schematic view of a swash plate type compressor in a third embodiment according to the present invention.

A swash plate type compressor 201 in a third embodiment will be explained with reference to FIG. 5. Hereinafter, different points from the swash plate type compressor 1 in the first embodiment will be explained.

In the swash plate type compressor 201, provided is a stopper 203 that restrains the slide valve 23 of the differential pressure control valve 21 in the close position. In a state where the position of the slide valve 23 is restrained by the stopper 203, a bypass passage 205 (an appropriate gap) is formed between the slide valve 23 and the introduction flow passage 17.

Accordingly, if the differential pressure control valve 21 rises, the slide valve 23 never close off the introduction flow passage 17 completely and a given amount of the refrigerant is sent to the crank chamber 15. Therefore, ensured is a function to reduce each discharge amount of the compression mechanisms 13 to its minimum value.

Note that, in this case, an amount of the refrigerant sent to the crank chamber 15 through the bypass passage 205 is sufficiently small compared with that in a full-closed state of the introduction flow passage 17 and thereby the excessive elevation of the crank pressure Pc never occurs.

<Fourth Embodiment>

Figure 6:
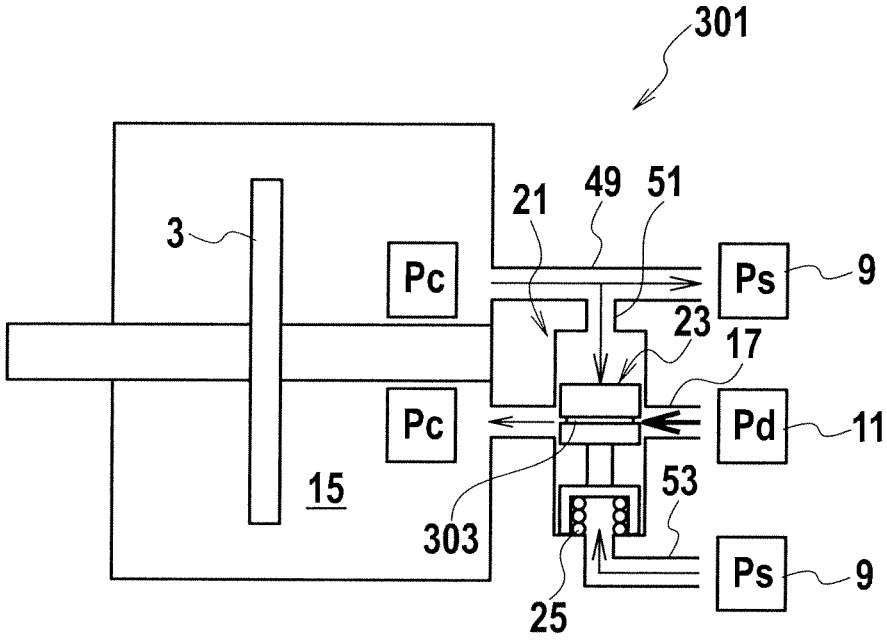
[FIG. 6] is a schematic view of a swash plate type compressor in a fourth embodiment according to the present invention.

A swash plate type compressor 301 in a fourth embodiment will be explained with reference to FIG. 6. Hereinafter, different points from the swash plate type compressor 1 in the first embodiment will be explained.

In the swash plate type compressor 301, a bypass groove (bypass passage) 303 is formed on the slide valve 23 of the differential pressure control valve 21.

Accordingly, if the slide valve 23 moves to the close position of the introduction flow passage 17 along with an elevation of the differential pressure (Pc−Ps), a given amount of the refrigerant is sent to the crank chamber 15 via the bypass groove 303. Therefore, ensured is a function to reduce each discharge amount of the compression mechanisms 13 to its minimum value.

Note that, in this case, an amount of the refrigerant sent to the crank chamber 15 through the bypass groove 303 is sufficiently small compared with that in a full-closed state of the introduction flow passage 17 and thereby the excessive elevation of the crank pressure Pc never occurs.

Note that the present invention is not construed to a limited extend in the above-described embodiment. The present invention can be modified variously within its technical scope.

For example, the bypass passage 303 in the fourth embodiment is not limited to the one formed as the bypass groove 303 described above. This bypass passage may be formed as a through hole provided on the valve body (slide valve 23).

The invention claimed is:

1. A swash plate type compressor comprising:

a swash plate provided swingably, a swash angle of the swash plate to a rotational central axis being adjustable;

a compression mechanism comprising a piston and a cylinder, and configured to be driven due to a swing of the swash plate to compress gas suctioned from a suction chamber and to discharge the compressed gas to a discharge chamber;

a crank chamber configured to apply a crank pressure to the swash plate and a head of the piston;

a capacity control valve configured to adjust the swash angle of the swash plate by introducing the gas in the discharge chamber to the crank chamber through an introduction flow passage; and a differential pressure control valve that is provided independently from the capacity control valve and is operable independently from the capacity control valve according to a differential pressure between the crank pressure of the crank chamber and a suction pressure of the compression mechanism, and, when operated, is configured to adjust an opening of the introduction flow passage to prevent the crank pressure from exceeding a predetermined value, wherein the differential pressure control valve includes a valve body and an urging unit that urges the valve body in a direction for opening the introduction flow passage;

wherein the valve body is configured to:

be provided movably between a close position and an open position of the introduction flow passage, receive a force for moving toward the close position by the crank pressure, receive a force for moving toward the open position by the suction pressure, and move to the close position to close the introduction flow passage when the differential pressure exceeds an urging force of the urging unit, wherein a bypass passage is formed on the valve body, and wherein the valve body and the bypass passage are configured such that a given amount of gas flows along the introduction flow passage through the bypass passage when the valve body moves to the close position.

* * * * *